US012704053B1

(12) United States Patent
Ejim

(10) Patent No.: US 12,704,053 B1
(45) Date of Patent: Aug. 11, 2026

(54) SPLIT POD SYSTEM AND METHODS

(71) Applicant: Saudi Arabian Oil Company, Dhahran (SA)

(72) Inventor: Chidirim Enoch Ejim, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/077,518

(22) Filed: Mar. 12, 2025

(51) Int. Cl.
*E21B 43/12* (2006.01)
*F04D 13/10* (2006.01)

(52) U.S. Cl.
CPC ..... *E21B 43/128* (2013.01); *F04D 13/10* (2013.01)

(58) Field of Classification Search
None
See application file for complete search history.

(56) References Cited

U.S. PATENT DOCUMENTS 8,448,699 B2 * 5/2013 Camilleri ..... E21B 43/38 166/54.1
11,802,465 B2 * 10/2023 Alghamdi ..... E21B 43/128
2006/0254957 A1 * 11/2006 Bohlig ..... B03B 9/062 209/12.1
2007/0274849 A1 * 11/2007 Martinez ..... E21B 43/128 417/423.3
2009/0266561 A1 * 10/2009 Cobb ..... E21B 43/38 166/66.4
2010/0122818 A1 5/2010 Rooks
2018/0216447 A1 * 8/2018 Al-Zahrani ..... E21B 33/12
2021/0246771 A1 * 8/2021 Ejim ..... E21B 43/128
2023/0220750 A1 * 7/2023 Alghamdi ..... E21B 43/128 166/369
2024/0287882 A1 * 8/2024 Alghamdi ..... F04D 13/10

OTHER PUBLICATIONS

Notification of Transmittal of the International Search Report and the Written Opinion of the International Searching Authority, or the Declaration dated Jun. 1, 2026 pertaining to International application No. PCT/US2026/018446 filed Mar. 10, 2026, pp. 1-19.

* cited by examiner

*Primary Examiner* — Blake Michener
(74) *Attorney, Agent, or Firm* — Dinsmore & Shohl LLP

(57) ABSTRACT

An electric submersible pump pod system includes an electric submersible pump (ESP), a pod casing, a connector housing, an electrical connector, and a cable. The ESP is fluidly coupled with a production string disposed within a wellbore. The pod casing is coupled with and houses at least a portion of the ESP such that an intake of the ESP is disposed within the pod casing. The pod casing is arranged to receive production fluid from the wellbore. The connector housing is coupled with the pod casing. The electrical connector is disposed at least partially within the connector housing and is electrically coupled with the ESP. The cable is electrically coupled with the electrical connector and is fluidly isolated from the production fluid within the pod casing.

18 Claims, 3 Drawing Sheets

SPLIT POD SYSTEM AND METHODS

TECHNICAL FIELD

This disclosure relates to well production methods and equipment, and more particularly to electric submersible pumps.

BACKGROUND

Electric submersible pumps (ESPs) are used to produce fluids from wellbores. Pod systems can be used to encapsulate ESPs and isolate portions of the wellbore from the wellbore fluids. Some wellbore fluids can be corrosive or otherwise damaging to the wellbore and downhole equipment. Methods and equipment for improving production using ESPs are sought.

SUMMARY

Implementations of the present disclosure include an electric submersible pump pod system that includes an electric submersible pump (ESP), a pod casing, a connector housing, an electrical connector, and a cable. The ESP is fluidly coupled with a production string disposed within a wellbore. The pod casing is coupled with and houses at least a portion of the ESP such that an intake of the ESP is disposed within the pod casing. The pod casing is arranged to receive production fluid from the wellbore. The connector housing is coupled with the pod casing. The electrical connector is disposed at least partially within the connector housing and electrically coupled with the ESP. The cable is electrically coupled with the electrical connector and fluidly isolated from the production fluid within the pod casing.

In some implementations, the pod casing defines, with a wall of the wellbore, an annulus fluidly isolated from the production fluid within the pod casing. In some implementations, the cable is disposed outside the pod casing with at least a portion of the cable residing within the annulus. In some implementations, the annulus includes a protector or inhibiting fluid.

In some implementations, the cable is a motor lead extension cable. In some implementations, the electrical connector is fluidly isolated from the production fluid within the pod casing.

In some implementations, the connector housing is a bulkhead coupled with the ESP and the pod casing. The electrical connector is disposed within the bulkhead and extends from the ESP, within the bulkhead, and through the pod casing.

In some implementations, the bulkhead is disposed between and coupled with a downhole section of the pod casing and an uphole section of the pod casing. In some implementations, the bulkhead defines fluid conduits fluidly coupling the downhole section of the pod casing with the uphole section of the pod casing.

In some implementations, the intake of the ESP is disposed within the uphole section of the pod casing. In some implementations, a motor of the ESP is disposed within the downhole section of the pod casing. The intake of the ESP is disposed within the uphole section of the pod casing, and at least a section of a pump of the ESP is disposed outside of the pod casing.

Implementations of the present disclosure also includes a wellbore assembly that includes an electric submersible pump (ESP), a casing, and a cable. The ESP is fluidly coupled with a production string disposed within a wellbore. The casing is coupled with the ESP and houses at least a portion of the ESP. The casing receives production fluid from the wellbore. The cable is electrically coupled with the ESP. The cable is fluidly isolated from the production fluid within the casing.

In some implementations, the wellbore assembly further includes an electrical connector electrically coupled with the ESP. The electrical connector is disposed at least partially within and coupled with the casing. The cable is electrically coupled with the electrical connector. In some implementations, the electrical connector is fluidly isolated from the production fluid within the casing.

In some implementations, the wellbore assembly further includes a bulkhead coupled with the ESP and the casing. The bulkhead houses the electrical connector. In some implementations, the bulkhead is disposed between and coupled with a downhole section of the casing and an uphole section of the casing. In some implementations, the bulkhead defines apertures fluidly coupling the downhole section of the casing with the uphole section of the casing.

In some implementations, the casing defines, with a wall of the wellbore, an annulus fluidly isolated from the production fluid within the casing. The cable is disposed outside the casing with at least a portion of the cable residing within the annulus.

Implementations of the present disclosure also include a method that includes electrically coupling a cable with an electric submersible pump (ESP). At least a portion of the ESP is disposed within a pod casing. The pod casing is coupled with an electrical connector electrically coupled with the ESP. The method also includes setting the ESP at a downhole location of a wellbore such that the pod casing is arranged to receive production fluid from the wellbore. Electrically coupling the cable includes connecting the cable with the electrical connector such that the cable is fluidly isolated from the production fluid within the pod casing. In some implementations, the setting includes coupling ESP with a downhole packer.

Particular implementations of the subject matter described in this specification can be implemented so as to realize one or more of the following advantages. For example, the ESP pod system of the present disclosure prevents the electrical connections of the ESP from being immersed in fluids that can damage the connections, which can reduce the susceptibility of ESP failure and increase reliability. Additional benefits include ease of integration into conventional ESP installations and the simplicity of the split pod system.

DETAILED DESCRIPTION OF THE DISCLOSURE

The present disclosure describes a pod system (e.g., a split pod system) for an electrical submersible pump (ESP). ESPs are used to lift wellbore fluids to the surface or, if at surface, to transfer fluid from one location to another. The pod system of the present disclosure includes a pod casing that includes two sections that can be axially coupled with each other. The ESP is distributed between the two sections. The uphole section houses the pump intake of the ESP and the downhole section houses the motor and the monitoring sub of the ESP. The bottom of the pod casing includes a portion that can sting into and form a seal with a packer. The two sections are connected to each other by a bulkhead.

The bulkhead includes flow ports for fluid flow between the two sections. The outer surface of the bulkhead includes an electrical connector to which an end of a power cable can be connected. The electrical connector is electrically connected with the motor of the ESP and any other component that needs electrical power. The power cable is run outside the housing and delivers power to the components inside the housing. This construction ensures that the power cable is not in contact with the reservoir fluid, which can be corrosive to the cable.

In some aspects, the ESP operates in harsh downhole environments. For example, the ESP can operate in the presence of high concentrations of corrosive gases such as H2S and CO2. If the electrical connections and cables are exposed to such fluids, the electrical connections and cables can fail, which can lead to a significant loss of time and resources. The pod system of the present disclosure helps protect the electrical connections of the ESP from such harsh environments.

Figure 1:
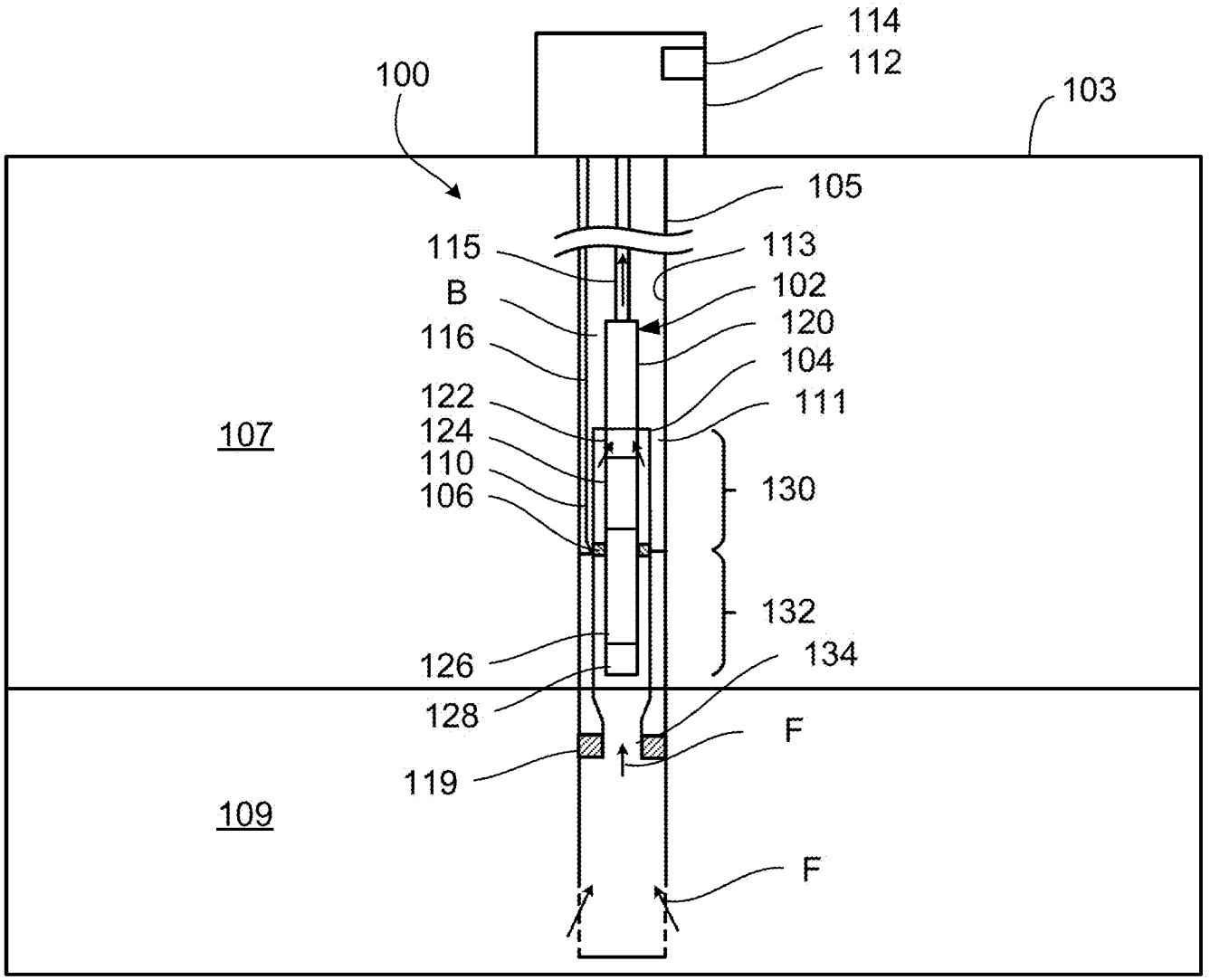
FIG. 1 shows a front schematic view, partially cross-sectional, of an example split pod system.

FIG. 1 shows an electric submersible pump pod system 100 (e.g., a split pod system, a wellbore system, a wellbore assembly, or an ESP assembly) that includes an ESP 102, a pod casing 104 (e.g., a housing or a shroud), a connector housing 106 (e.g., a bulkhead), an electrical connector 108 (shown in FIG. 4), and a cable 110 (e.g., a motor lead extension cable or a power cable). The ESP 102 is fluidly coupled with a wellbore string 115 (e.g., a production string or coiled tubing) that is disposed within a wellbore 105. The wellbore string 115 extends from and is attached to surface equipment 112 such as a wellhead, a Christmas tree, a rig, etc.

The wellbore 105 extends through a subterranean zone 107 that includes a geologic formation 109. For example, the wellbore 105 extends down from a surface 103 (e.g., a terranean surface) of the wellbore 105 into the geologic formation 109. In some aspects, the geologic formation 109 includes a reservoir from which fluid "F" (e.g., production fluid such as hydrocarbons including oil or gas, or other wellbore fluids such as water) can be extracted.

The pod casing 104 is coupled with the ESP 102 and houses at least a portion of the ESP 102. In some aspects, the pod casing 104 is attached to a packer 119 (e.g., an isolation packer, a production packer, or a downhole packer). For example, when installing the ESP pod system 100, the pod casing 104 can "sting" into the packer 119 to form a fluid seal. For example, the pod casing 104 is a pressure-tight shroud so that, when the pod casing 104 is attached to the packer 119, the ESP 102 (or a portion of the ESP) is encapsulated inside the pressure tight shroud and fluidly isolated from the areas outside the pod casing 104. For example, the pod casing 104 defines, with a wall 113 (e.g., a casing wall) of the wellbore 105, an annulus 111. The annulus 111 is fluidly isolated from the fluid "F" that is within the pod casing 104 and below the isolation packer 119.

In some aspects, the ESP 102 includes a pump 120 (e.g., a centrifugal pump), a pump intake 122, a protector 124, a motor 126, and a monitoring sub 128 (e.g., monitoring tool). The cable 110 delivers the needed electrical power to the ESP 102 from the surface. For example, the cable 110 is coupled with a power source 114 at the surface and delivers electrical power from such power source 114 to the motor 126 and other components of the ESP such as the monitoring sub 128. The power source 114 can be coupled with or be part of the surface equipment 112. In some aspects, the cable 110 is a motor lead extension (MLE) coupled with a main power cable 116. In some aspects, the cable 110 also provides communication and other data (e.g., instructions to and from a controller such as a surface controller) to control the ESP 102. The cable 110 and the main power cable 116 can form the complete power string that delivers the power from the power source 114 to the ESP 102.

The motor 126 receives electrical power from the cable 110 to operate the pump 120. For example, when the motor 126 is powered by the cable 110, the motor 126 provide the mechanical power required to drive the pump 120 through a shaft. The protector 124 can protect the motor 126 by preventing the fluid "F" from entering the motor 126. The protector 124 can also perform other functions such as absorbing the thrust load from the pump 120, transmitting mechanical power from the motor 129 to the pump 120, equalizing pressure, and providing additional motor oil as temperature changes. The pump 120 provides head to lift the fluid "F" to the surface 103 or to another ESP within the wellbore 105. The monitoring sub 128 can be coupled with the motor 126 to measure parameters such as pump intake and discharge pressures, motor oil, and winding temperature and vibration. In some aspects, the measured downhole data is transmitted to the surface 103 via cable 110.

The cable 110 is disposed outside the pod casing 104 so that the cable 110 is not exposed to the fluid "F" inside the pod casing 104. In some aspects, at least a portion of the cable 110 resides within the annulus 111, where the cable 110 is protected from the corrosive environment that is inside the pod casing 104. For example, the annulus 111 (and the wellbore section or annulus uphole of the ESP 102) has non-corrosive environment and is fluidly decoupled from the fluid "F." In some aspects, the annulus 111 contains an inhibiting fluid "B" (e.g., an inhibited brine, an inhibited diesel, or any type of fluid that protects the integrity of the inner walls of the casing) that protects the cable 110 and the inner wall 113 of the wellbore casing to maintain the structural rigidity of the such casing. In some aspects, the cable 110 does not necessarily need a metal housing (e.g., a metal jacket or premium metallurgy) that could otherwise be needed if the cable 110 was submerged or in contact with the fluid "F."

The pod casing 104 includes an uphole section 130 and a downhole section 132. The connector housing 106 resides between the uphole section 130 and the downhole section 132. In some aspects, the uphole section 130 houses the intake 122 and the protector 124, and the downhole section 132 houses the motor 126 and the monitoring sub 128.

The pod casing 104 receives the fluid "F" from the wellbore 105, which receives the fluid "F" from the geologic formation 109. For example, the pod casing 104 has an open downhole end 134 that stings into the packer 119 and forms an inlet for the fluid "F" to come into the pod casing 104. The ESP 102 receives the fluid "F" that is inside the pod casing 104 through the pump intake 122 to lift the fluid "F" to the surface.

Figure 2:
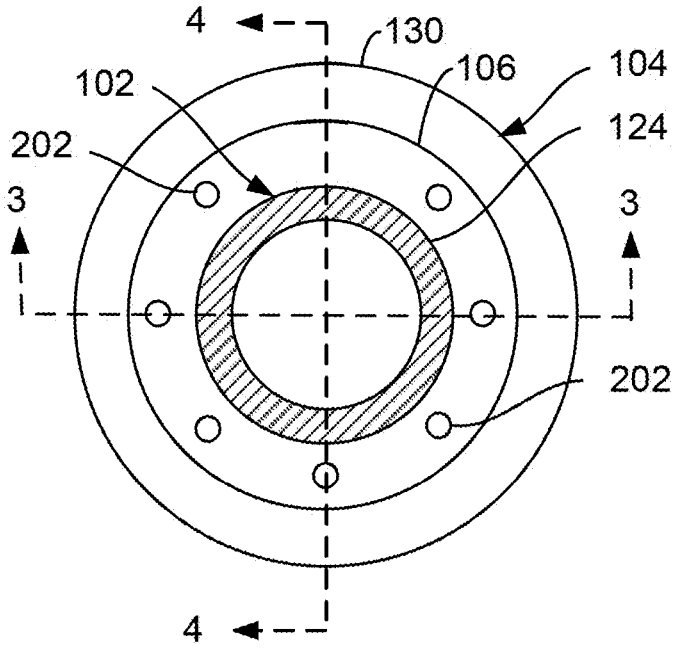
FIG. 2 shows a top schematic view, cross-sectional, of an example portion of the split pod system.

FIG. 2 shows a top cross-sectional view of the ESP pod system 100 (or a different variation or implementation of the ESP pod system 100). As shown, the ESP 102 coupled with the connector housing 106, which is connected with the pod casing 104. For example, the motor 126 of the ESP 102 is attached to the connector housing 106. The connector housing has fluid conduits 202 (e.g., apertures or channels) that fluidly connect the uphole section 130 of the pod casing 104 with the downhole section 132 of the pod casing 104.

Figure 3:
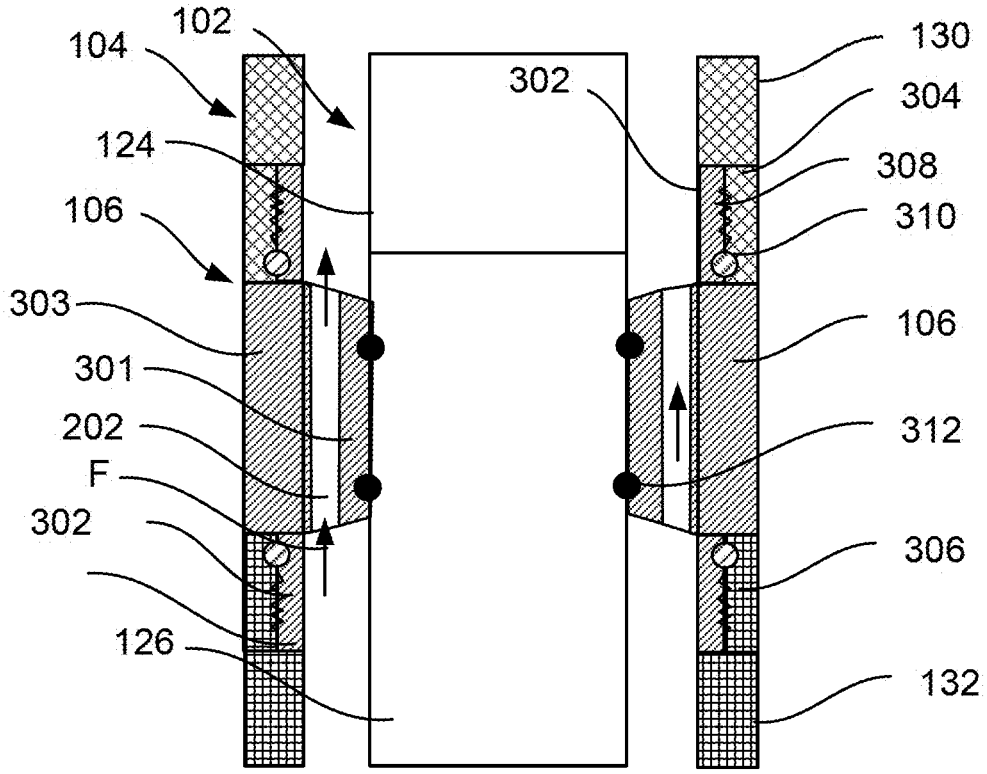
FIG. 3 shows a cross sectional view of the example portion of the split pod system along line 3-3 in FIG. 2.

FIG. 3 shows a cross section along line 3-3 in FIG. 2. As shown, the connector housing 106 includes an ESP connection portion 303 (e.g., an annular inner body) and a pod casing connection portion 303 (e.g., an annular outer body). The fluid conduits 202 extend along the length of ESP connection portion 303. The pod casing connection portion 303 includes threaded ends 302 that extend axially to connect with respective threaded ends 304, 306 of the uphole section 130 and downhole section 132, respectively. Such threaded connections ensure a flush and smooth transition of the overall outer diameter of the pod system. The connector housing 106 also includes seal rings 310, 312 (e.g., O-rings) at the connection interfaces between the connector housing 106 and the ESP 102, and the connection interfaces between the connector housing uphole and downhole sections 130, 132 of the pod casing 104.

In some aspects, the connector housing 106 serves as bulkhead, physically dividing the uphole section 130 from the downhole section 132 and allowing fluid to flow between the sections 130, 132 only though the fluid conduits 202. The connector housing can have more (or less) fluid conduits and such conduits 202 can be larger or smaller. The connector housing 106 is mechanically attached to the ESP 102 with, for example, mechanical fasteners, a threaded connection, an adhesive, or other suitable connection. In some aspects, the connector housing 106 is attached to the motor 126 so that the connector housing 106 resides downhole of the protector 124.

Figure 4:
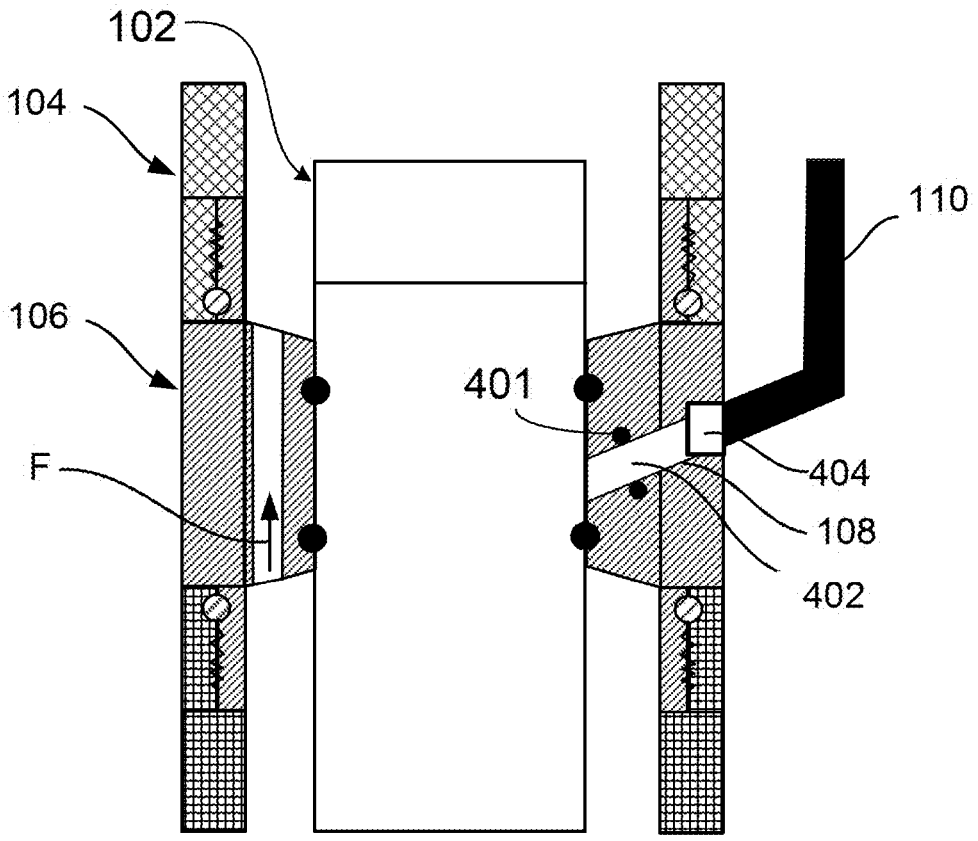
FIG. 4 shows a cross sectional view of the example portion of the split pod system along line 4-4 in FIG. 2.

FIG. 4 shows a cross section along line 4-4 in FIG. 2. As shown, the electrical connector 108 is disposed at least partially within the connector housing 106. The electrical connector 108 is electrically coupled with the ESP 102. In some aspects, the electrical connector 108 includes an electrical cable 402 (e.g., an electrical contact) and a power receptacle 404. Thus, the electrical connector 108 can extend from the ESP 102, within the connector housing 106, and through the pod casing 104.

The electrical cable 402 is isolated (e.g., fluidly sealed) from the fluid "F" by the connector housing 106. Moreover, the connector housing can include seal rings 401 (e.g., O-rings) that, if fluid enters the inner cavity containing the electrical connector 108, prevent the fluid "F" from flowing up to the cable 110.

In some aspects, the power receptacle 404 houses part of the cable 110. In some aspects, less than 5 centimeters is disposed inside the power receptacle 404. For example, between 1 and 5 centimeters (e.g., 1, 2, 3, 4, 5 centimeters, or any fraction or range in between) of the cable 110 is disposed within the power receptacle 404.

Thus, the connector housing 106 (e.g., bulkhead) serves several functions. The connector housing 106 connects the top and bottom sections of the split pod, has flow ports for fluid flow from the bottom to the top section and vice versa (as occurs in a bull-heading operation), and serves as an electrical connection point between the cable 110 and the ESP motor.

Figure 5:
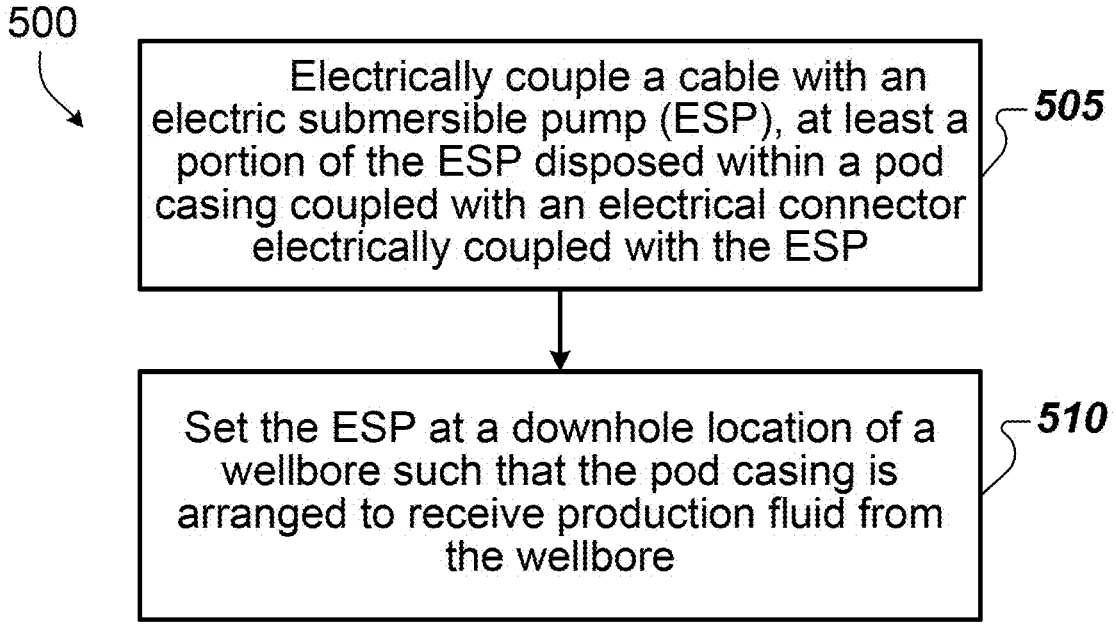
FIG. 5 shows a flow chart of an example method of installing an ESP.

FIG. 5 shows a flow chart of an example method 500 of installing or operating an ESP (e.g., the ESP 102 in FIG. 1). The method includes electrically coupling a cable with an ESP, where at least a portion of the ESP is disposed within a pod casing and the pod casing is coupled with an electrical connector electrically coupled with the ESP (505). The method also includes setting the ESP at a downhole location of a wellbore such that the pod casing is arranged to receive production fluid from the wellbore (510). Electrically coupling the cable includes connecting the cable with the electrical connector such that the cable is fluidly isolated from the production fluid within the pod casing.

The disclosure has discussed the use of a split pod for tubing-deployed ESP system, which can be installed and retrieved using a rig. However, the split pod can also be used in a rigless system, such as in a coiled-tubing deployed ESP system with the power cable attached to the other diameter of the coiled tubing. The configuration could be the same as shown in FIG. 1, with the main exception being that the production tubing is replaced with a coiled tubing.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

EXAMPLES

In an example implementation, an electric submersible pump pod system comprises: an electric submersible pump (ESP) fluidly coupled with a production string disposed within a wellbore; a pod casing coupled with and housing at least a portion of the ESP such that an intake of the ESP is disposed within the pod casing, the pod casing arranged to receive production fluid from the wellbore; a connector housing coupled with the pod casing; an electrical connector disposed at least partially within the connector housing and electrically coupled with the ESP; and a cable electrically coupled with the electrical connector and fluidly isolated from the production fluid within the pod casing.

In an example implementation combinable with any other example implementation, the pod casing defines, with a wall of the wellbore, an annulus fluidly isolated from the production fluid within the pod casing.

In an example implementation combinable with any other example implementation, the cable is disposed outside the pod casing with at least a portion of the cable residing within the annulus.

In an example implementation combinable with any other example implementation, the annulus comprises a protector fluid.

In an example implementation combinable with any other example implementation, the cable is a motor lead extension cable.

In an example implementation combinable with any other example implementation, the electrical connector is fluidly isolated from the production fluid within the pod casing.

In an example implementation combinable with any other example implementation, the connector housing is a bulkhead coupled with the ESP and the pod casing, the electrical connector disposed within the bulkhead and extending from the ESP, within the bulkhead, and through the pod casing.

In an example implementation combinable with any other example implementation, the bulkhead is disposed between and coupled with a downhole section of the pod casing and an uphole section of the pod casing.

In an example implementation combinable with any other example implementation, the bulkhead defines fluid conduits fluidly coupling the downhole section of the pod casing with the uphole section of the pod casing.

In an example implementation combinable with any other example implementation, the intake of the ESP is disposed within the uphole section of the pod casing.

In an example implementation combinable with any other example implementation, a motor of the ESP is disposed within the downhole section of the pod casing, the intake of the ESP is disposed within the uphole section of the pod casing, and at least a section of a pump of the ESP is disposed outside of the pod casing.

In another example implementation, a wellbore assembly comprises: an electric submersible pump (ESP) fluidly coupled with a production string disposed within a wellbore; a casing coupled with the ESP and housing at least a portion of the ESP, the casing arranged to receive production fluid from the wellbore; and a cable electrically coupled with the ESP; wherein the cable is fluidly isolated from the production fluid within the casing.

In an example implementation combinable with any other example implementation, the wellbore assembly further comprises an electrical connector electrically coupled with the ESP, the electrical connector disposed at least partially within and coupled with the casing, wherein the cable is electrically coupled with the electrical connector.

In an example implementation combinable with any other example implementation, the electrical connector is fluidly isolated from the production fluid within the casing.

In an example implementation combinable with any other example implementation, the wellbore assembly further comprises a bulkhead coupled with the ESP and the casing, the bulkhead housing the electrical connector.

In an example implementation combinable with any other example implementation, the bulkhead is disposed between and coupled with a downhole section of the casing and an uphole section of the casing.

In an example implementation combinable with any other example implementation, the bulkhead defines apertures fluidly coupling the downhole section of the casing with the uphole section of the casing.

In an example implementation combinable with any other example implementation, the casing defines, with a wall of the wellbore, an annulus fluidly isolated from the production fluid within the casing, the cable disposed outside the casing with at least a portion of the cable residing within the annulus.

In an example implementation, a method comprises: electrically coupling a cable with an electric submersible pump (ESP), at least a portion of the ESP disposed within a pod casing, the pod casing coupled with an electrical connector electrically coupled with the ESP; and setting the ESP at a downhole location of a wellbore such that the pod casing is arranged to receive production fluid from the wellbore; wherein electrically coupling the cable comprises connecting the cable with the electrical connector such that the cable is fluidly isolated from the production fluid within the pod casing.

In an example implementation combinable with any other example implementation, the setting comprises coupling ESP with a downhole packer.

What is claimed is:

1. An electric submersible pump pod system, comprising:

an electric submersible pump (ESP) fluidly coupled with a production string disposed within a wellbore;

a pod casing coupled with and housing at least a portion of the ESP such that an intake of the ESP is disposed within the pod casing, the pod casing arranged to receive production fluid from the wellbore;

a connector housing coupled with the pod casing;

an electrical connector disposed at least partially within the connector housing and electrically coupled with the ESP; and a cable electrically coupled with the electrical connector and fluidly isolated from the production fluid within the pod casing;

wherein the connector housing is a bulkhead coupled with and extending from an external surface of the ESP to the pod casing, the electrical connector disposed within the bulkhead and extending from the ESP, within the bulkhead, and through the pod casing, and the bulkhead defines apertures that allow fluid to pass through the bulkhead to the intake of the ESP.

2. The electric submersible pump pod system of claim 1, wherein the pod casing defines, with a wall of the wellbore, an annulus fluidly isolated from the production fluid within the pod casing.

3. The electric submersible pump pod system of claim 2, wherein the cable is disposed outside the pod casing with at least a portion of the cable residing within the annulus.

4. The electric submersible pump pod system of claim 2, wherein the annulus comprises an inhibiting fluid.

5. The electric submersible pump pod system of claim 1, wherein the cable is a motor lead extension cable.

6. The electric submersible pump pod system of claim 1, wherein the electrical connector is fluidly isolated from the production fluid within the pod casing.

7. The electric submersible pump pod system of claim 1, wherein the bulkhead is disposed between and coupled with a downhole section of the pod casing and an uphole section of the pod casing.

8. The electric submersible pump pod system of claim 7, wherein the apertures comprise fluid conduits fluidly coupling the downhole section of the pod casing with the uphole section of the pod casing.

9. The electric submersible pump pod system of claim 8, wherein the intake of the ESP is disposed within the uphole section of the pod casing.

10. The electric submersible pump pod system of claim 8, wherein a motor of the ESP is disposed within the downhole section of the pod casing, the intake of the ESP is disposed within the uphole section of the pod casing, and at least a section of a pump of the ESP is disposed outside of the pod casing.

11. The electric submersible pump pod system of claim 1, wherein the connector housing comprises an ESP connection portion and a pod casing connection portion, the ESP connection portion shaped as an annular inner body attached to the external surface of the ESP and the pod casing connection portion shaped as an annular outer body attached to the pod casing, and the ESP connection portion defines the apertures.

12. A wellbore assembly, comprising:

an electric submersible pump (ESP) fluidly coupled with a production string disposed within a wellbore;

a casing coupled with the ESP and housing at least a portion of the ESP, the casing arranged to receive production fluid from the wellbore;

a cable electrically coupled with the ESP;

an electrical connector electrically coupled with the ESP and the electrical connector; and a bulkhead coupled with the ESP and the casing, the bulkhead housing the electrical connector;

wherein the cable is fluidly isolated from the production fluid within the casing and at least a portion of the cable within the wellbore is disposed outside of the casing, and wherein the bulkhead is coupled with and extends from an external surface of the ESP to the casing, the electrical connector extending from the ESP, within the bulkhead, and through the casing, and the bulkhead defines apertures that allow fluid to pass through the bulkhead to a fluid intake of the ESP.

13. The wellbore assembly of claim 12, wherein the electrical connector is fluidly isolated from the production fluid within the casing.

14. The wellbore assembly of claim 12, wherein the bulkhead is disposed between and coupled with a downhole section of the casing and an uphole section of the casing.

15. The wellbore assembly of claim 14, wherein the bulkhead defines apertures fluidly coupling the downhole section of the casing with the uphole section of the casing.

16. The wellbore assembly of claim 12, wherein the casing defines, with a wall of the wellbore, an annulus fluidly isolated from the production fluid within the casing, the cable disposed outside the casing with at least a portion of the cable residing within the annulus.

17. A method, comprising:

electrically coupling a cable with an electric submersible pump (ESP), at least a portion of the ESP disposed within a pod casing, the pod casing coupled with an electrical connector electrically coupled with the ESP, the electrical connector disposed within a connector housing that is coupled with and extends from an external surface of the ESP to the pod casing, connector housing defining apertures that allow fluid to pass through the bulkhead to the intake of the ESP; and setting the ESP at a downhole location of a wellbore such that the pod casing is arranged to receive production fluid from the wellbore;

wherein electrically coupling the cable comprises connecting the cable with the electrical connector such that the cable is fluidly isolated from the production fluid within the pod casing, with the electrical connector extending from the ESP, within the connector housing, and through the pod casing.

18. The method of claim 17, wherein the setting comprises coupling the ESP with a downhole packer.

* * * * *